US011547923B2

(12) United States Patent
Labonte

(10) Patent No.: US 11,547,923 B2
(45) **Date of Patent: *Jan. 10, 2023**

(54) SKATE AND SKATE BOOT

(71) Applicant: BAUER HOCKEY, LLC, Exeter, NH (US)

(72) Inventor: Ivan Labonte, Montreal (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/135,555

(22) Filed: Sep. 19, 2018

(65) Prior Publication Data

US 2019/0015727 A1 Jan. 17, 2019

Related U.S. Application Data

(63) Continuation of application No. 15/212,980, filed on Jul. 18, 2016, now Pat. No. 10,105,585, which is a (Continued)

(51) Int. Cl.

| | |
|---|---|
| ***A43B 5/16*** | (2006.01) |
| ***A63B 71/12*** | (2006.01) |
| ***A43B 5/04*** | (2006.01) |

(52) U.S. Cl.

CPC ..... *A63B 71/1225* (2013.01); *A43B 5/0405* (2013.01); *A43B 5/0415* (2013.01); *A43B 5/1691* (2013.01); *A63B 2071/1275* (2013.01)

(58) Field of Classification Search

CPC ..... A43B 5/16; A43B 5/1666; A43B 5/1691; A43B 5/0405; A43B 5/0415; A43B 5/0464

See application file for complete search history.

(56) References Cited

U.S. PATENT DOCUMENTS

| | | | |
|---|---|---|---|
| 2,097,200 | A | 12/1936 | Menutole |
| 2,563,763 | A | 8/1951 | Vietas |

(Continued)

FOREIGN PATENT DOCUMENTS

| | | |
|---|---|---|
| CA | 2809462 | 2/2019 |
| EP | 2777415 | 11/2014 |
| WO | 2009049244 | 4/2009 |

OTHER PUBLICATIONS

European search report issued by the EPO dated Aug. 5, 2013 in connection with EP patent application No. 13159481.4.

(Continued)

*Primary Examiner* — Ted Kavanaugh

(57) ABSTRACT

A skate boot comprising an outer shell with a heel portion for receiving the heel of the foot; an ankle portion for receiving the ankle, the ankle portion comprising a rear portion for facing at least partially the lower part of the Achilles tendon; and medial and lateral side portions for facing the medial and lateral sides of the foot respectively. The skate boot also comprises a tendon guard extending upwardly from the ankle portion of the outer shell for facing at least partially the upper part of the Achilles tendon, the tendon guard comprising a recess for receiving an insert. The tendon guard has a first flexion mode when no insert is received in the recess and a second flexion mode when the insert is received in the recess. The second flexion mode is different from the first flexion mode.

23 Claims, 17 Drawing Sheets

Related U.S. Application Data continuation of application No. 13/827,080, filed on Mar. 14, 2013, now Pat. No. 9,408,435.

(56) References Cited

U.S. PATENT DOCUMENTS

| | | | | |
|---|---|---|---|---|
| 4,655,465 | A | 4/1987 | Schaeffer | |
| 4,864,743 | A | 9/1989 | Begey | |
| 4,869,001 | A | 9/1989 | Brown | |
| 5,343,640 | A * | 9/1994 | Mattiuzzo | A43B 5/0433 36/117.1 |
| 5,487,227 | A * | 1/1996 | Marmonier | A43B 5/04 36/117.1 |
| 5,498,033 | A | 3/1996 | Hoshizaki | |
| 5,832,635 | A * | 11/1998 | Finney | A43B 5/0401 36/118.8 |
| 5,901,469 | A | 5/1999 | Saillet | |
| 6,012,726 | A | 1/2000 | Grande | |
| 6,112,434 | A | 9/2000 | Seltzer | |
| 6,360,454 | B1 * | 3/2002 | Dachgruber | A43B 5/0401 36/117.1 |
| 6,557,865 | B1 * | 5/2003 | Reuss | A43B 5/0401 280/14.21 |
| 7,204,495 | B2 | 4/2007 | Reuss | |
| 7,686,321 | B2 | 3/2010 | Cunningham | |
| 9,408,435 | B2 * | 8/2016 | Labonte | A43B 5/1691 |
| 10,105,585 | B2 * | 10/2018 | Labonte | A43B 5/1691 |
| 2003/0204971 | A1 * | 11/2003 | Fauver | A43B 7/20 36/89 |
| 2005/0229436 | A1 | 10/2005 | Bock | |
| 2011/0101665 | A1 | 5/2011 | Van Horne | |
| 2014/0259780 | A1 | 9/2014 | Labonte | |
| 2016/0325172 | A1 | 11/2016 | Labonte | |

OTHER PUBLICATIONS

Restriction Requirement issued by the USPTO on Sep. 25, 2015 in connection with U.S. Appl. No. 13/827,080.

Non-Final Office Action issued by the USPTO dated Dec. 9, 2015 in connection with U.S. Appl. No. 13/827,080.

Examiner's Report issued by CIPO dated Nov. 16, 2015 in connection with CA patent application No. 2,809,462.

Notice of Allowance issued by the USPTO dated Apr. 4, 2016 in connection with U.S. Appl. No. 13/827,080.

Examiner's Report issued by CIPO dated Aug. 3, 2016 in connection with CA patent application No. 2,809,462.

Non-Final Office Action issued by the USPTO dated Dec. 20, 2017 in connection with U.S. Appl. No. 15/212,980.

Notice of Allowance issued by the USPTO dated Jun. 26, 2018 in connection with U.S. Appl. No. 15/212,980.

* cited by examiner

SKATE AND SKATE BOOT

CROSS-REFERENCE TO RELATED APPLICATIONS

This application is a continuation of U.S. patent application Ser. No. 15/212,980, filed on Jul. 18, 2016, which is a continuation of U.S. patent application Ser. No. 13/827,080, filed on Mar. 14, 2013, now U.S. Pat. No. 9,408,435. The contents of the aforementioned applications are incorporated by reference herein.

FIELD OF THE INVENTION

The present invention relates to a skate boot having a tendon guard with a recess for receiving an insert and wherein the flexibility of the tendon guard may be adjusted by a skater between different flexion modes.

BACKGROUND OF THE INVENTION

Tendon guards are known to be used on hockey skates to protect the Achilles heel of the skater from being cut from another ice skate blade or from any other type of impact from another skater.

While tendon guards are capable of providing protection, the implementation of the tendon guard could result in a loss of flexibility of the skater's foot. More specifically, tendon guards which are too rigid can be obstructive to the extension of a skater's foot which regularly occurs during skating maneuvers. Such an obstruction is uncomfortable and undesirable for a skater as it can substantially affect performance.

As such, some tendon guards have been constructed with substantially flexible material in order to accommodate the flexing action of a skater's foot. However, a skater is often limited by the design of the manufacturer in terms of the flexibility provided by the tendon guard. As such, skaters may be more likely to omit the use of the tendon guard than to search for a skate or tendon guard providing the desired level of flexibility.

Furthermore, it can be understood that a variety of different skaters are likely to have different needs (and preferences) with regard to the level of flexibility of the tendon guard. For example, some skater's may prefer a tendon guard which exhibits a high level of flexibility while other may prefer a more rigid tendon guard. In addition, individual preferences may change over time, thereby further highlighting the deficiency of prior art tendon guards which are produced with a predefined flexibility.

Accordingly, there is an ongoing need in the industry for an improved skate boot structure which overcomes the aforementioned problems and which can accommodate a plurality of different skating styles, modes, types or fashions, as well as the need to provide a skate boot wherein the skater may adjust the flexibility of the tendon guard between different flexion modes.

SUMMARY OF THE INVENTION

In accordance with an aspect of the present invention, there is provided a skate boot for enclosing a human foot when in use, the foot having a heel, an ankle with a medial malleolus and a lateral malleolus, an Achilles tendon having an upper part and a lower part that projects away from the upper part, the lower part merging with the heel, a plantar surface, medial and lateral sides and toes. The skate boot comprises an outer shell comprising a heel portion for receiving the heel of the foot; an ankle portion for receiving the ankle, the ankle portion comprising a rear portion for facing at least partially the lower part of the Achilles tendon; and medial and lateral side portions for facing the medial and lateral sides of the foot respectively. The skate boot also comprises a tendon guard extending upwardly from the ankle portion of the outer shell for facing at least partially the upper part of the Achilles tendon, the tendon guard allowing backwards flexion of the ankle when the foot moves towards full extension. The tendon guard comprises a recess for receiving an insert. The tendon guard has a first flexion mode when no insert is received in the recess and a second flexion mode when the insert is received in the recess, the second flexion mode being different from the first flexion mode.

In accordance with another aspect of the present invention, there is provided a skate boot for enclosing a human foot when in use, the foot having a heel, an ankle with a medial malleolus and a lateral malleolus, an Achilles tendon having an upper part and a lower part that projects away from the upper part, the lower part merging with the heel, a plantar surface, medial and lateral sides and toes. The skate boot comprises an outer shell comprising a heel portion for receiving the heel of the foot; an ankle portion for receiving the ankle, the ankle portion comprising a rear portion for facing at least partially the lower part of the Achilles tendon; and medial and lateral side portions for facing the medial and lateral sides of the foot respectively. The skate boot also comprises a tendon guard extending upwardly from the ankle portion of the outer shell for facing at least partially the upper part of the Achilles tendon, the tendon guard allowing backwards flexion of the ankle when the foot moves towards full extension. The tendon guard comprises a recess for receiving an insert, wherein, in use, a first insert selected among a plurality of inserts is mounted in the recess such that the tendon guard has a first flexion mode.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of embodiments of the present invention is provided hereinbelow with reference to the following drawings, in which.

Figure 1:
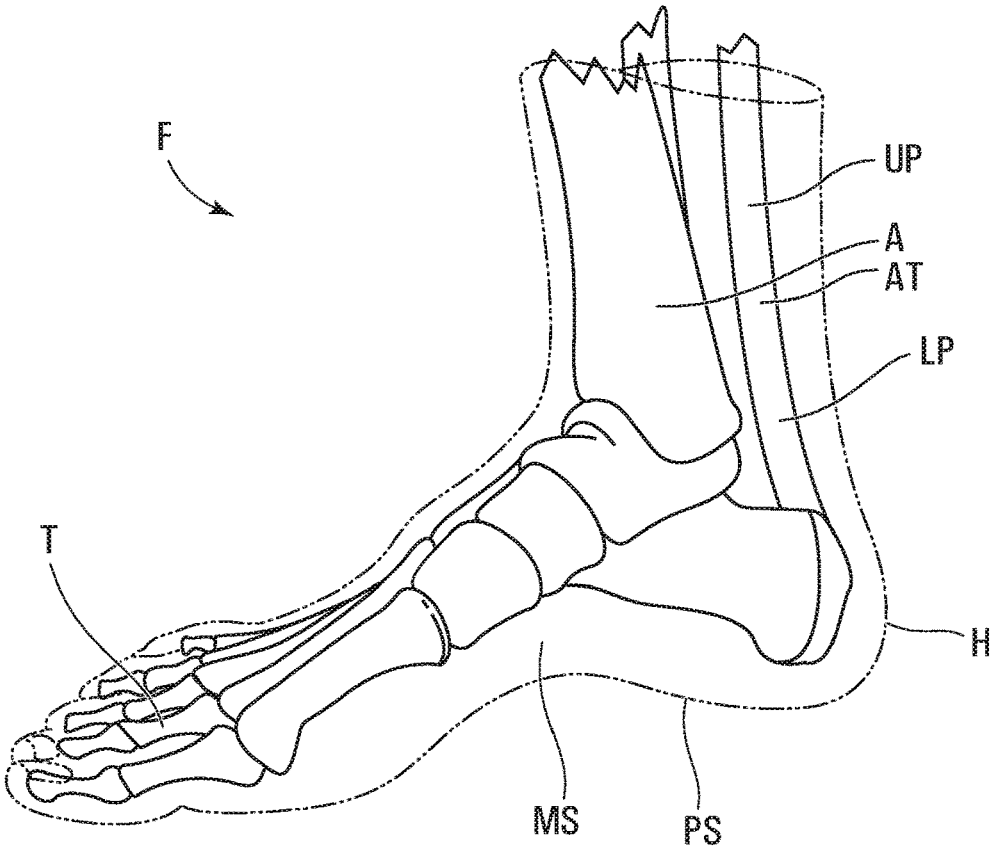
FIG. 1 is a side view of a right human foot with the integument of the foot shown in dotted lines and the bones shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
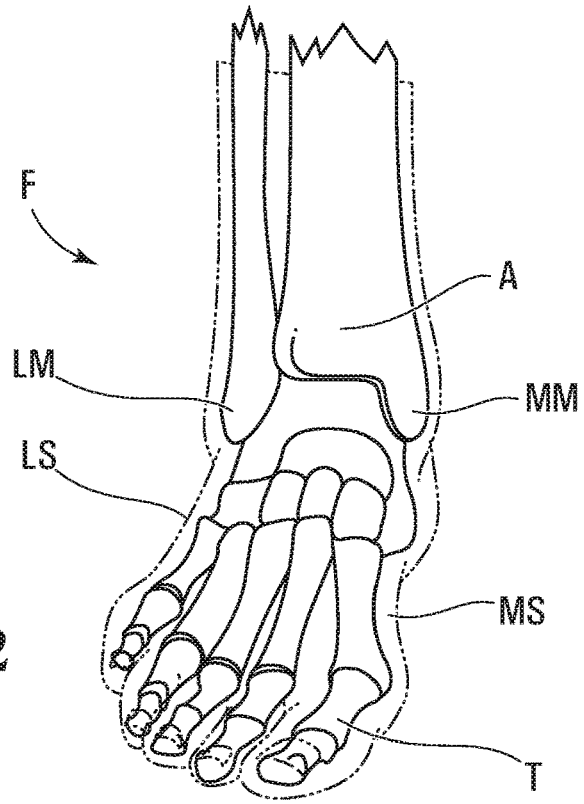
FIG. 2 is a front view of the human foot of FIG. 1.

Shown in FIGS. 1 and 2 is a typical right human foot F that includes toes T, a plantar surface PS, a medial side MS and a lateral side LS. In addition, the human foot F includes a heel H, an Achilles tendon AT and an ankle A having a lateral malleolus LM and a medial malleolus MM, the lateral malleolus LM being at a lower position than the medial malleolus MM. The Achilles tendon AT has an upper part UP and a lower part LP projecting away from the upper part UP, the lower part LP merging with the heel H.

Figure 3:
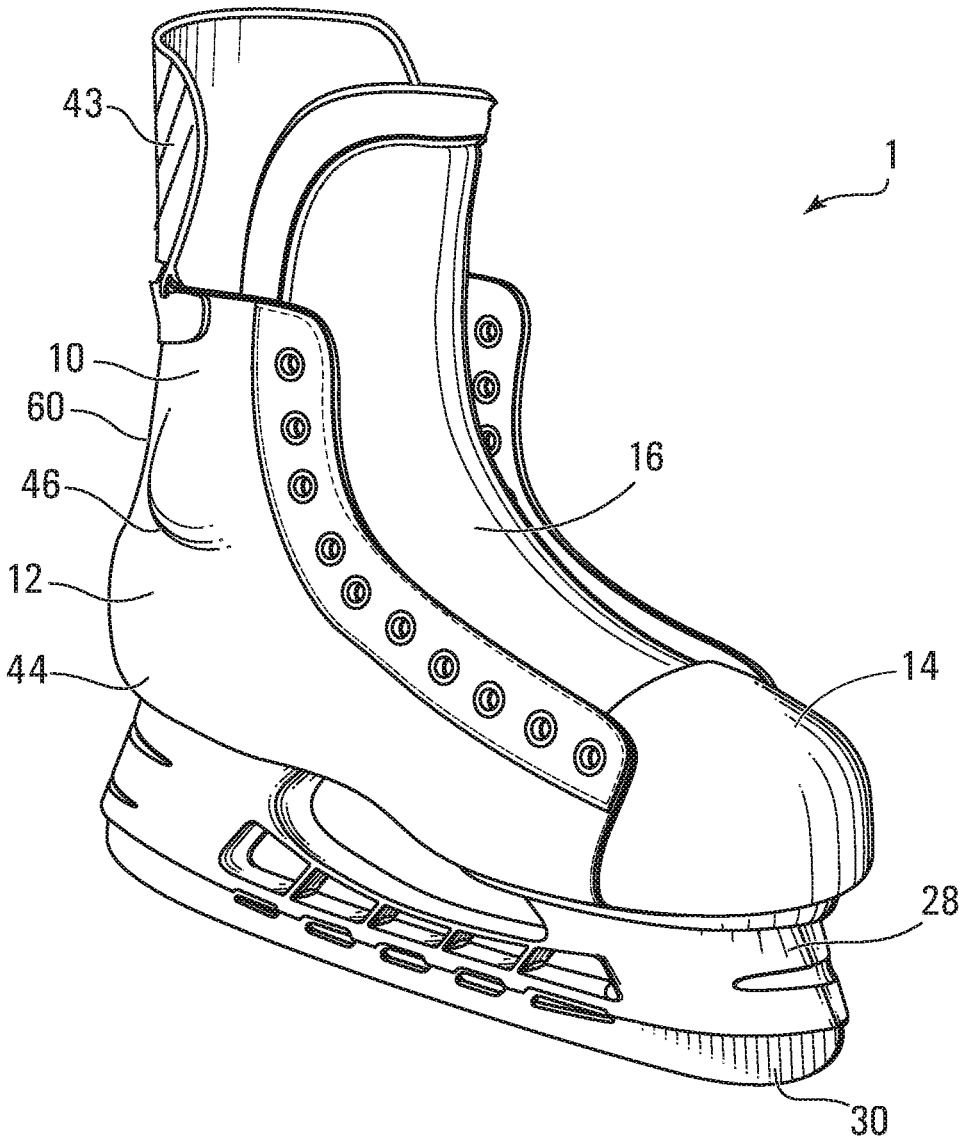
FIG. 3 is a perspective view of an ice skate in accordance with the present invention.
Figure 4:
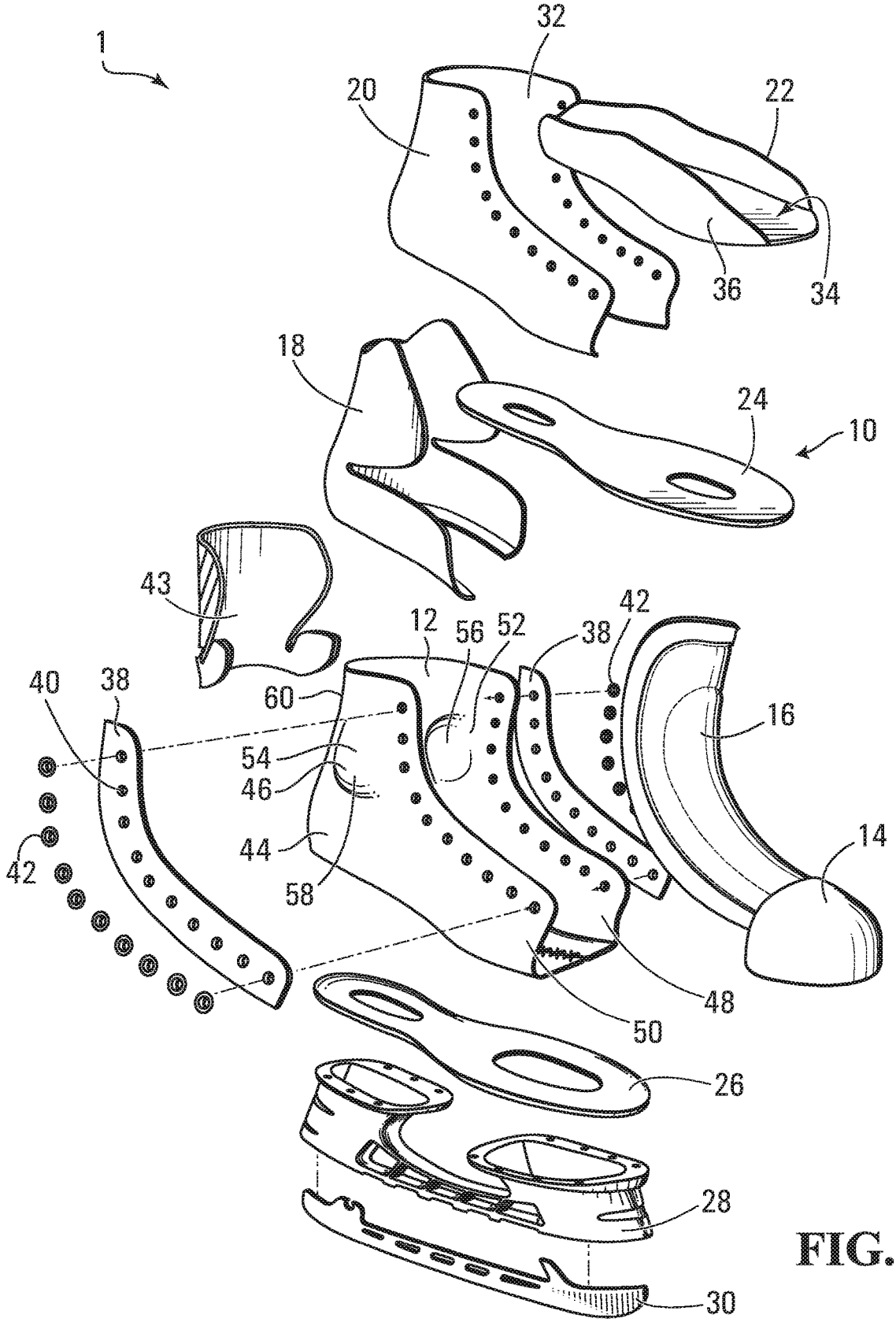
FIG. 4 is an exploded view of the ice skate of FIG. 3.

Shown in FIGS. 3 and 4 is an ice skate 1 that comprises a skate boot 10 suitable for enclosing the foot F. Although the skate boot 10 shown in the figures is being used for an ice skate 1, it is understood that the skate boot 10 can be used for a roller skate.

The ice skate 1 has an outer shell 12 for receiving the foot F, a toe cap 14 made of rigid molded plastic for facing the toes T, a tongue 16 extending upwardly and rearwardly from the toe cap 14 for covering a forefoot of the foot F, a rigid insert 18 for providing more rigidity around the ankle A and heel H, an inner lining 20, a footbed 22, an insole 24, an outsole 26, an ice skate blade holder 28 and a blade 30. The rigid insert 18 may be glued to an inner surface of the outer shell 12. It is understood that the rigid insert 18 is an optional component and may be eliminated if the outer shell 12 is sufficiently rigid for supporting the ankle A and heel H. Similarly, the insole 24 and outsole 26 are optional components and may be eliminated if the outer shell 12 is sufficiently rigid for receiving the blade holder 28.

The inner lining 20 is affixed to an inner surface of the outer shell 12 and it comprises an inner surface 32 intended for contact with the heel H, ankle A and medial and lateral sides MS, LS of the foot F in use. If the skate boot 10 comprises the rigid insert 18, such rigid insert 18 is sandwiched between the outer shell 12 and inner lining 20 and such inner lining 20 may be glued to the inner surfaces of the outer shell 12 and rigid insert 18 and stitched along its periphery to the outer shell 12. The inner lining 20 is made of a soft material and can be a fabric made of 100% NYLON® fibers. The footbed 22 is mounted inside the outer shell 12 and it comprises an upper surface 34 for receiving the plantar surface PS and a wall 36 projecting upwardly from the upper surface 34. The wall 36 partially cups the heel H and extends up to a medial line of the foot F.

The skate boot 10 also comprises bands 38 secured to upper side portions of the outer shell 12. The bands 38 may be made of fabric, textile or leather and comprise apertures 40. Eyelets 42 are punched into each of the bands 38, outer shell 12 and inner lining 20 vis-à-vis apertures 40.

The outer shell 12 may be made of a thermoformable material. As used herein, the expression "thermoformable material" refers to a material that is capable of softening when heated and of hardening again when cooled. Some non-limiting examples of different types of thermoformable material comprise ethylene vinyl acetate (EVA) foam, polyethylene foam, polystyrene foam, polypropylene foam and thermoformable materials sold under the trade-marks MEGABIX®, SURLYN®, SONTARA®, FORMO500®, BYLON®, MOSOCA® and NYLON® 66.

The outer shell 12 comprises a heel portion 44 for receiving the heel H, an ankle portion 46 for receiving the ankle A and medial and lateral side portions 48, 50 for facing the medial and lateral sides MS, LS respectively. These components form a foot receiving cavity that conforms to the general shape of the foot F.

The heel portion 44 may be thermoformed such that it is substantially cup shaped for following the contour of the heel H.

The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM. The lateral depression 58 is located slightly lower than the medial depression 56, for conforming to the morphology of the foot F. The ankle portion 46 further comprises a rear portion 60 facing the lower part LP of the Achilles tendon AT. The rear portion 60 may be thermoformed such that it follows the lower part LP of the Achilles tendon AT. The medial and lateral side portions 48, 50 extend forwardly from the heel and ankle portions 44, 46.

The outer shell 12 also comprises a tendon guard 43 for facing at least partially the upper part UP of the Achilles tendon AT. The tendon guard 43 allows backwards flexion of the ankle A when the foot F moves towards full extension. The tendon guard 43 may be made of silicone or may be made by injection molding using polyester (e.g. polyester HYTREL®) polyurethane, polyamide, or other suitable thermoplastics. The selected material may have enough flexibility to allow the tendon guard 43 to flex rearwardly when pressure is applied on it while it should also have enough resiliency to allow the tendon guard 43 to return to its initial position when pressure is no longer applied on it.

Figure 5:
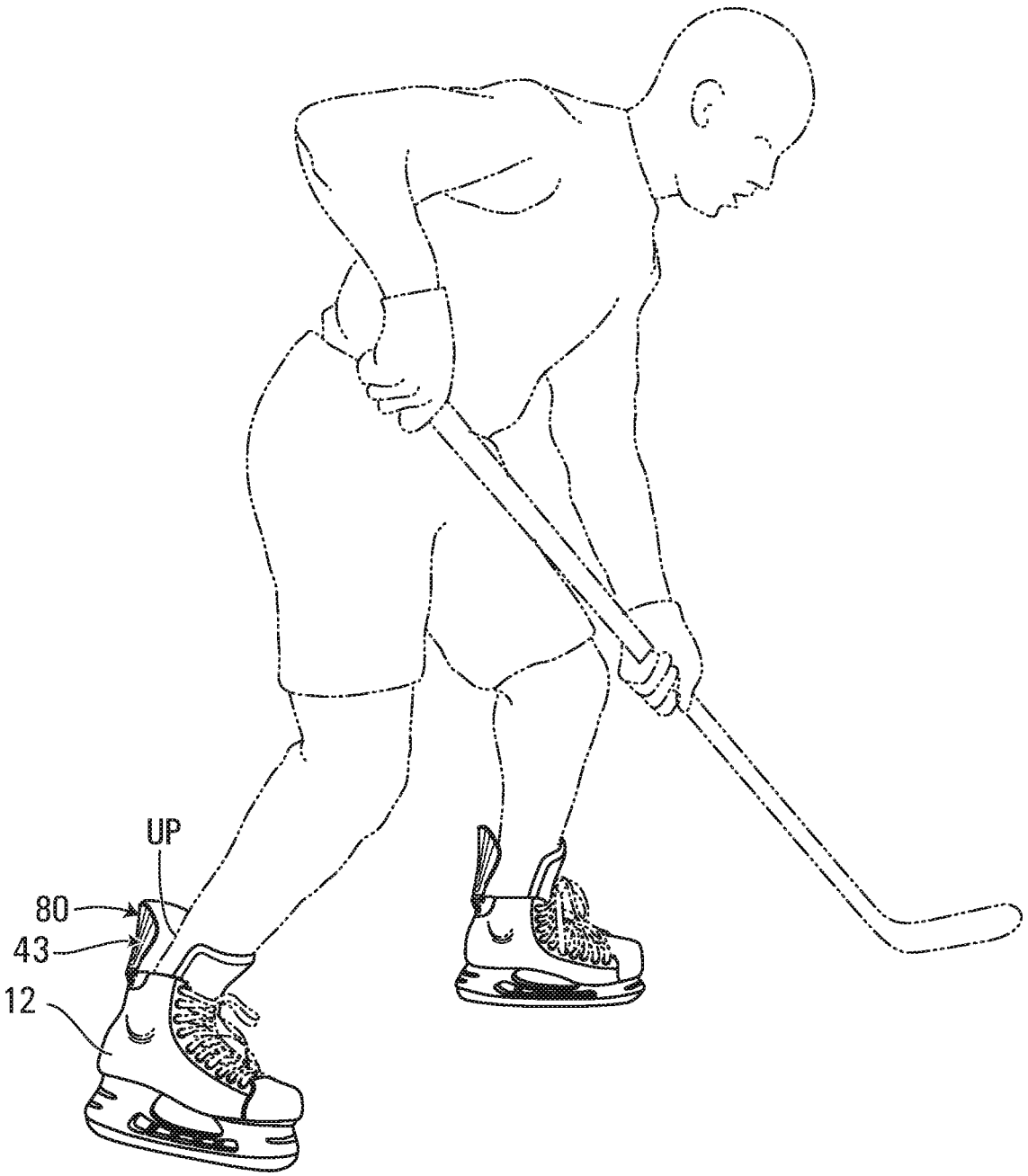
FIG. 5 shows a skater in a first skating position.
Figure 6:
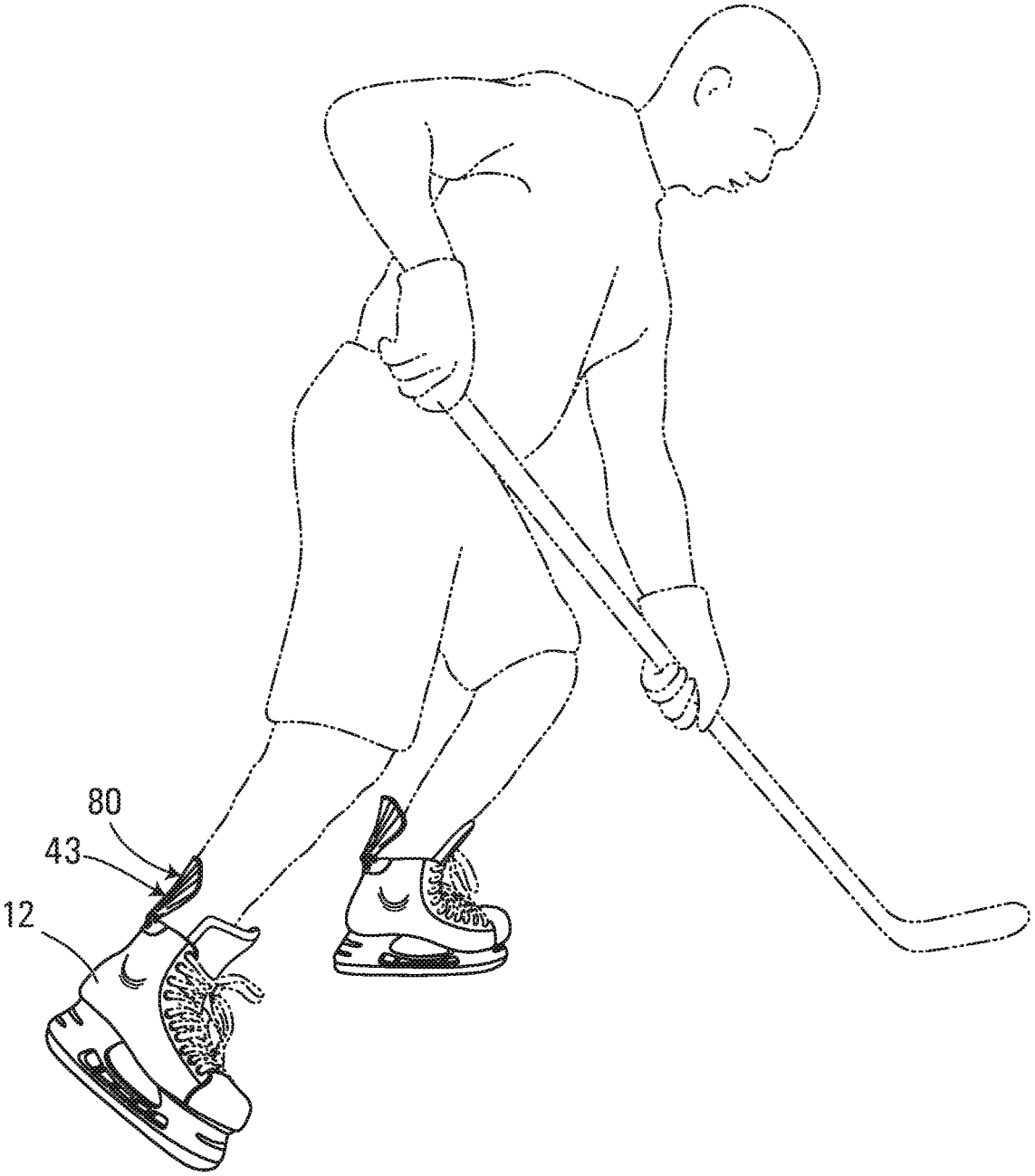
FIG. 6 shows the skater of FIG. 5 in a second skating position.
Figure 7:
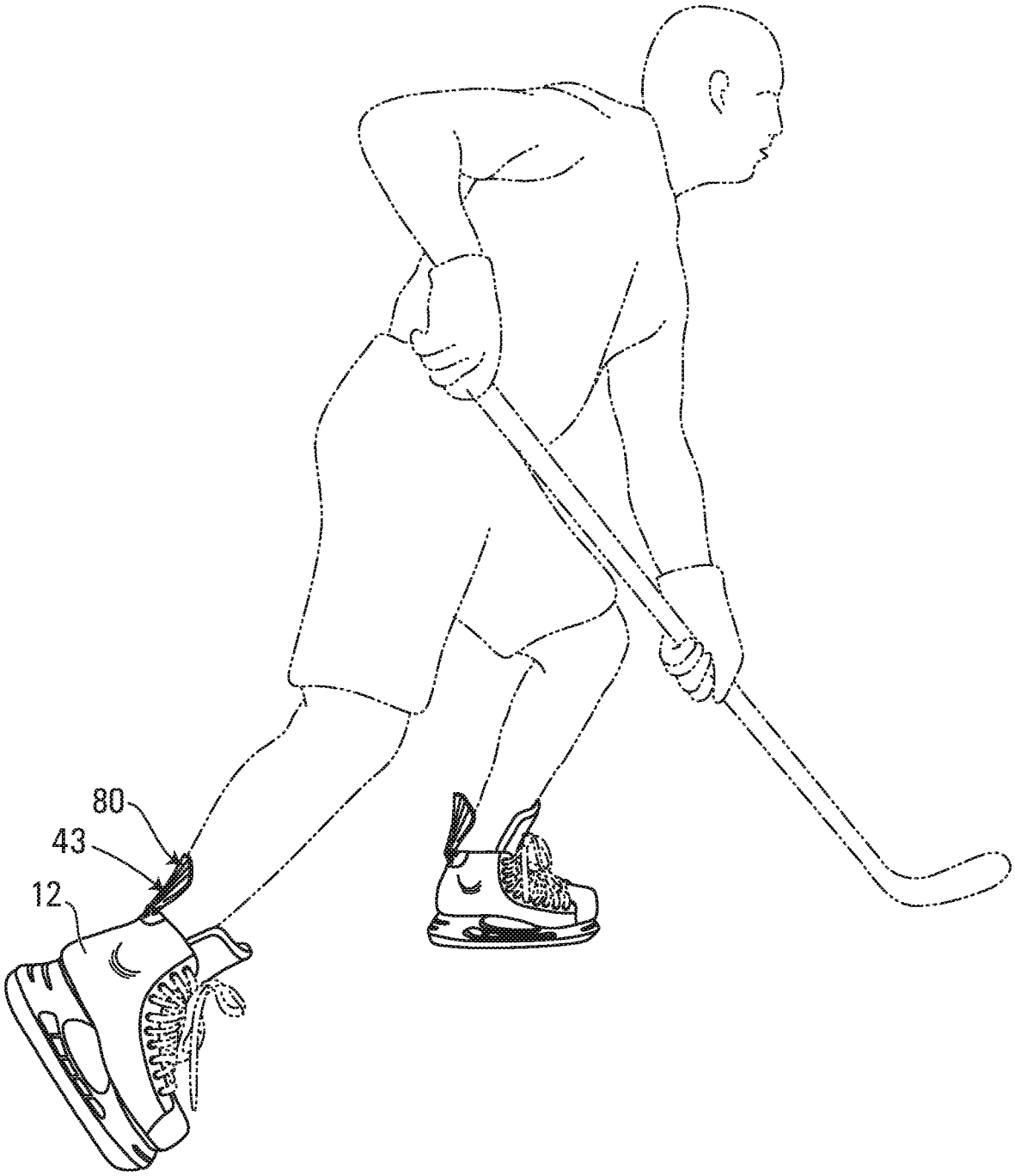
FIG. 7 shows the skater of FIG. 5 in a third skating position.

FIGS. 5 to 7 show a skater in different skating positions.

In FIG. 5, the right foot of the skater begins the pushing action against the ice. As shown in this figure, a flexing portion 80 of the tendon guard 43 faces at least partially the upper part UP of the Achilles tendon AT but does not contact the upper part UP.

In FIG. 6, the right foot of the skater continues its pushing action until the flexing portion 80 of the tendon guard 43 eventually abuts against the upper part UP of the Achilles tendon AT.

Figure 8:
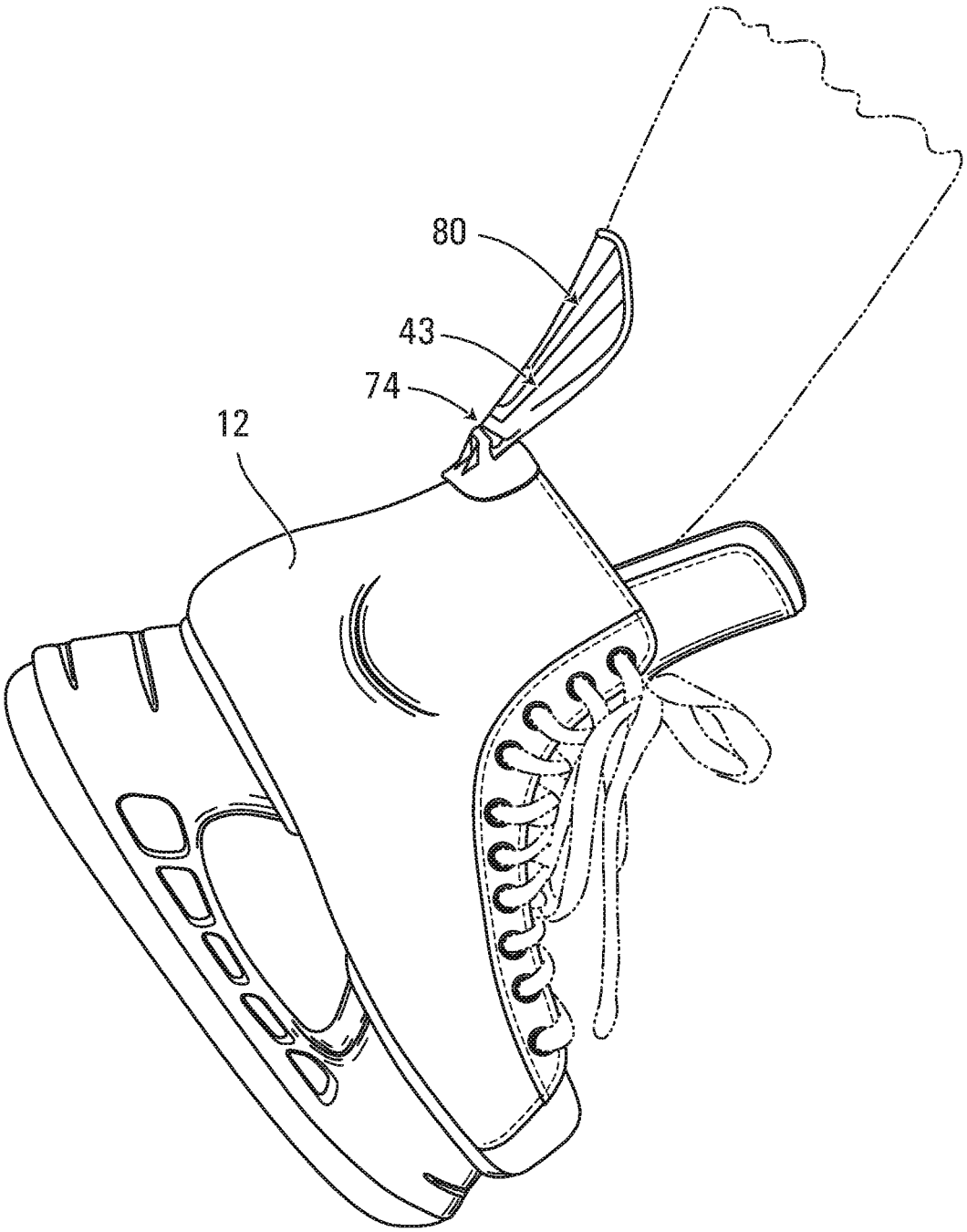
FIG. 8 is an enlarged view of the right skate of FIG. 7.

As shown in FIGS. 7 and 8, when the right foot of the skater continues its pushing action and reaches full extension, the flexing portion 80 allows backwards flexion of the ankle A when the foot F of the skater moves towards full extension.

After reaching full push extension, the foot F of the skater moves forwardly without touching the ice and another pushing motion of the foot F will begin once the skate touches the ice again. It is understood that the tendon guard 43 should return to its initial position shown in FIG. 5 once the full push extension of the foot is completed.

Figure 9:
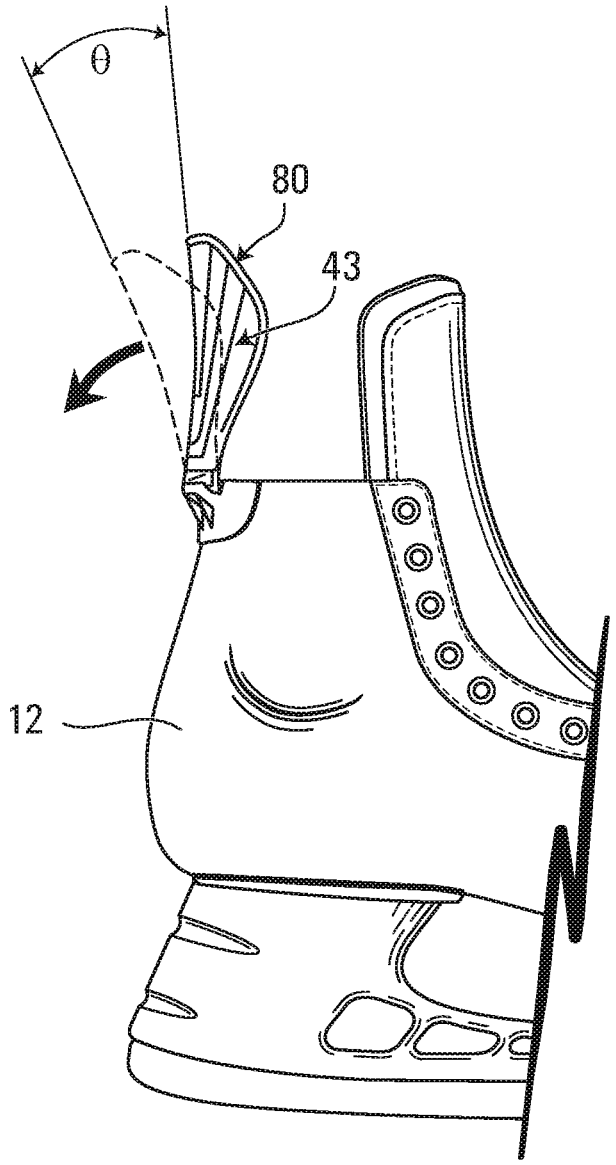
FIG. 9 is a partial side elevational view of the ice skate of FIG. 3 showing a bent position of the tendon guard in dotted lines and an unbent position of the tendon guard in solid lines.
Figure 10:
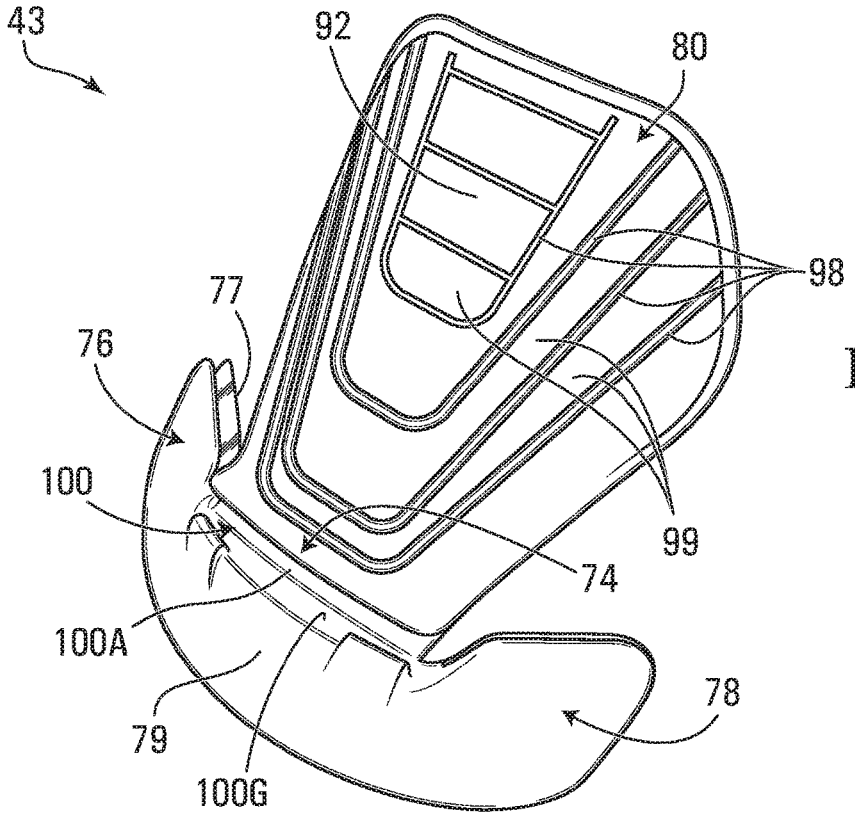
FIG. 10 is a top perspective view of a tendon guard in accordance with the present invention.

As shown in FIG. 9, in its initial position shown in full lines, the tendon guard 43 is in a generally vertical position. When the ankle A flexes backwards and pressure is applied against the flexing portion 80 of the tendon guard 43, the tendon guard 43, as shown in dotted lines, is then capable of flexing rearwardly of an angle θ which may be up to 90°.

The tendon guard 43 will now be described in further detail with reference to FIGS. 10 to 21. The tendon guard 43 includes a bottom portion 74 and the flexing portion 80 that projects upwardly from the bottom portion 74 for facing at least partially the upper part UP of the Achilles tendon AT. The bottom portion 74 of the tendon guard 43 is affixed to the ankle portion 46 as will be described in further detail below. The tendon guard 43 may also comprise medial and lateral side portions 76, 78 extending forwardly from the bottom portion 74 and being affixed to the respective medial and lateral ankle sides 52, 54 of the ankle portion 46.

Figure 11:
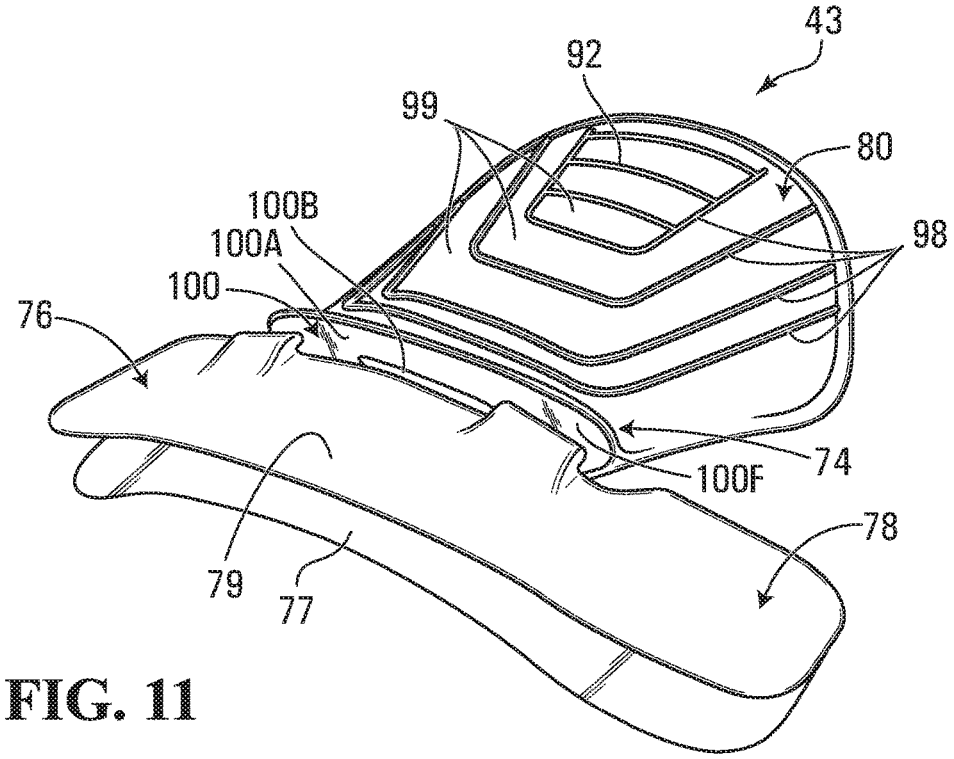
FIG. 11 is a bottom perspective view of the tendon guard of FIG. 10.
Figure 17:
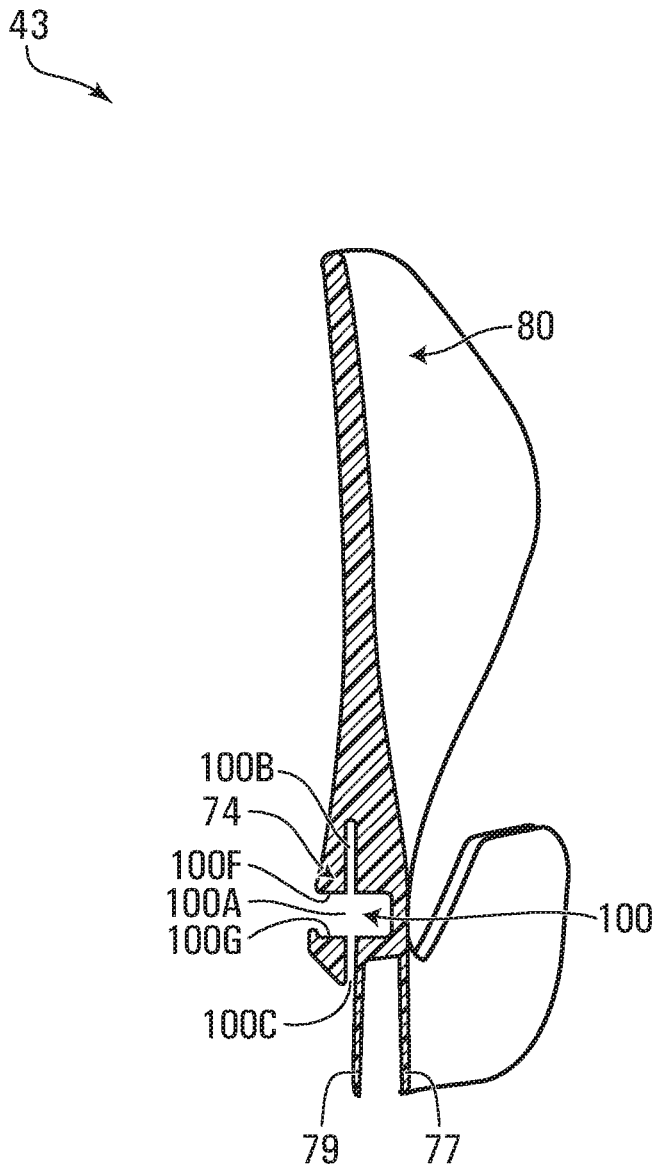
FIG. 17 is a cross-sectional view of the tendon guard of FIG. 12 taken along cross-sectional lines 17-17.

As best shown in FIGS. 11 and 17, the bottom portion 74 of the tendon guard 43 acts as an attachment portion for attaching the tendon guard 43 to the outer shell 12. More specifically, the bottom portion 74 of the tendon guard 43 has a substantially U-shaped groove defined by a front wall 77 and a rear wall 79. The front and rear walls 77, 79 are at least partially receiving therebetween the top edge portion of the rear portion 60 of the ankle portion 46 when the tendon guard 43 is positioned onto the outer shell 12. As such, the tendon guard 43 can be easily attached to the outer shell 12.

Although a specific embodiment is depicted in the figures, other arrangements can be envisioned for affixing the tendon guard 43 to the skate boot 10. For example, the bottom portion 74 of the tendon guard 43 can form a single wall made of one or more layers that are attached to the inner or outer side of the top edge portion of the rear portion 60 of the ankle portion 46 or that are inserted and glued and/or affixed within layers of the outer shell.

The tendon guard 43 can be fixedly attached to the ankle portion 46 via stitching, over molding, thermal bonding, high frequency welding, vibration welding, piping, zipper, adhesive and staples, among other possibilities known in the art.

It is understood that the tendon guard may alternatively form an integral part of the outer shell or the upper part of the ankle portion.

In another embodiment, the tendon guard may be removably attached to the outer shell such that the skater can replace the tendon guard should the tendon guard be damaged or can select among different tendon guards.

Figure 12:
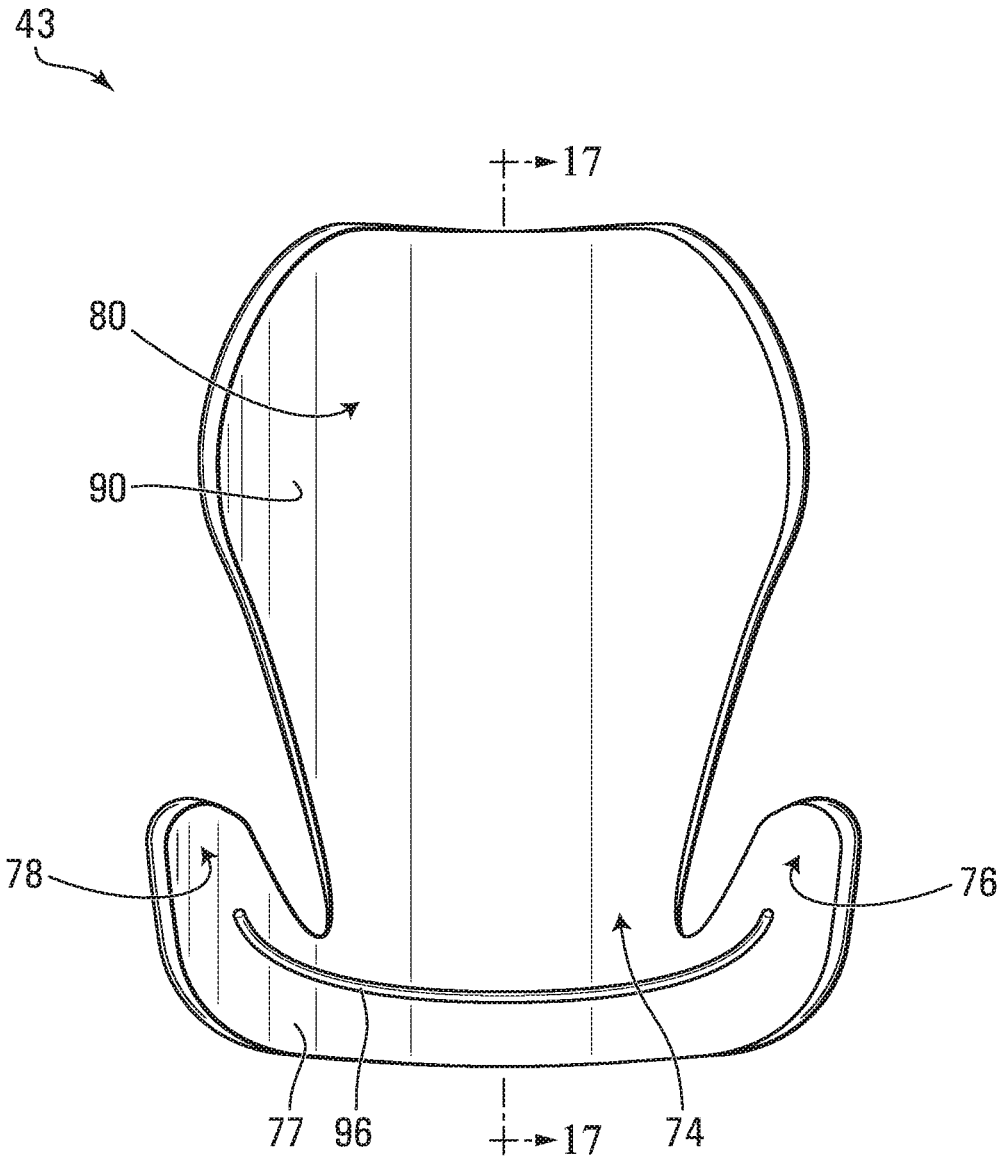
FIG. 12 is a front view of the tendon guard of FIG. 10.
Figure 13:
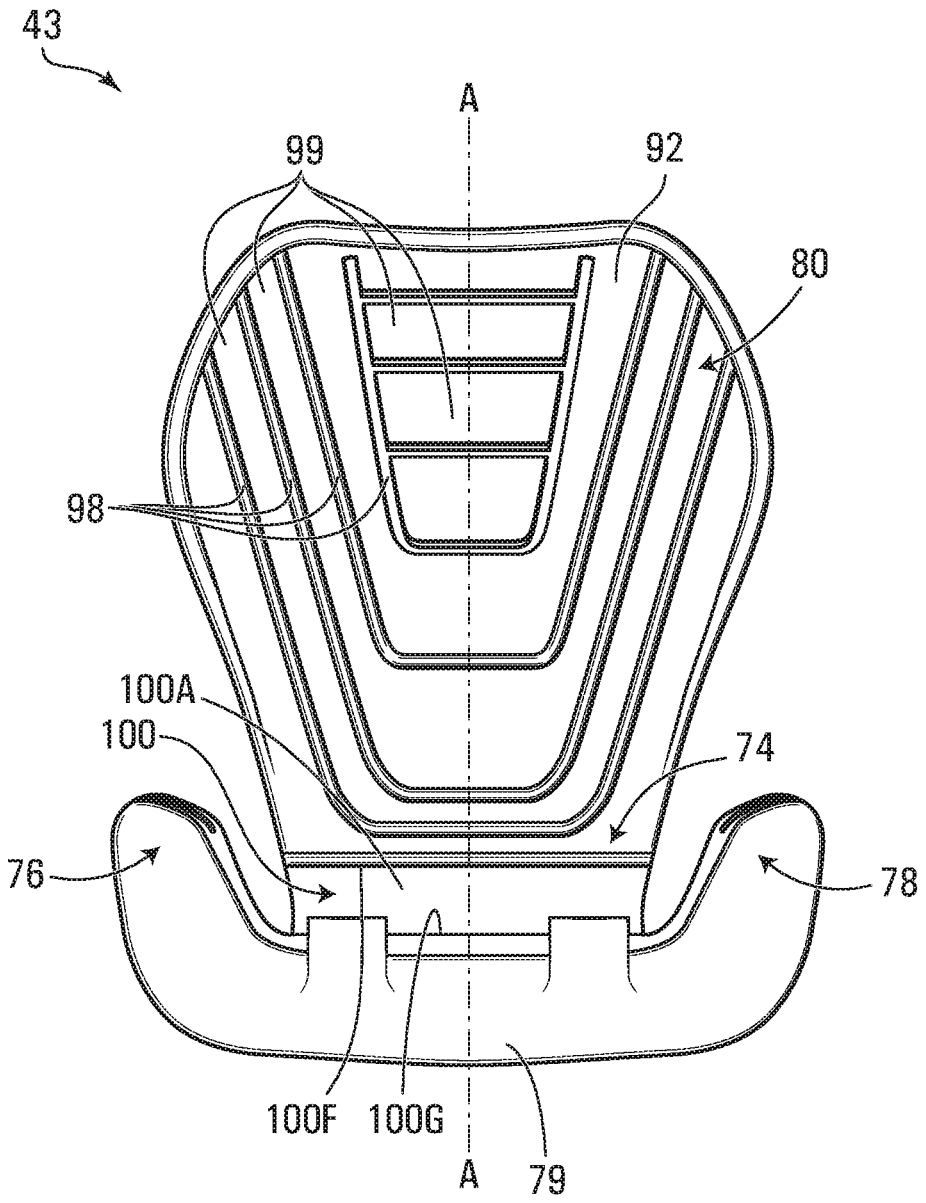
FIG. 13 is a rear view of the tendon guard of FIG. 10.

The tendon guard 43 has an inner surface 90 and an outer surface 92. As shown in FIG. 12, the inner surface 90 may have a projection 96 for increasing attachment bonding between the tendon guard 43 and the outer shell 12. The inner surface 90 may be covered by the inner lining 20 such that the inner surface of the outer shell 12 shows a uniform lining surface. The outer surface 92 may have a series of reinforcement elements defined by regions of increased thickness (as depicted by projections 98) and/or a series of regions of decreased thickness (as depicted by recesses 99). As such, specific regions of the tendon guard 43 can be made thicker to rigidify the tendon guard 43 in those regions, while other regions can be made thinner to increase the flexibility of the tendon guard 43 in those regions. The tendon guard may also have projections and/or recesses that are for aesthetic value.

The tendon guard 43 has a substantially symmetrical arrangement and could be used to protect the Achilles tendon of either of the right or left legs. However, the tendon guard can be shaped to specifically fit a given one of the right or left legs. For example, different tendon guards can be shaped to have an additional protective portion which at least partially wraps around a lateral portion of the respective leg in order to provide further protection. As such, although the tendon guards of such an embodiment will be symmetrical with respect to one another, a given tendon guard may not be symmetrical along its longitudinal axis.

As shown in FIGS. 7 and 8, as the tendon guard 43 bends, the lower region of the flexing portion 80 acts as a flexible hinge. As such, it may be desirable to increase the thickness of the tendon guard 43 in the lower region to enable the tendon guard 43 to sustain tensile and compressive forces incurred during bending and to avoid plastic deformation of the tendon guard 43.

Thus, the flexibility of the tendon guard 43 can be selectively designed based on different parameters such as its thickness, shape, material and the presence of projections and/or recesses.

Figure 14:
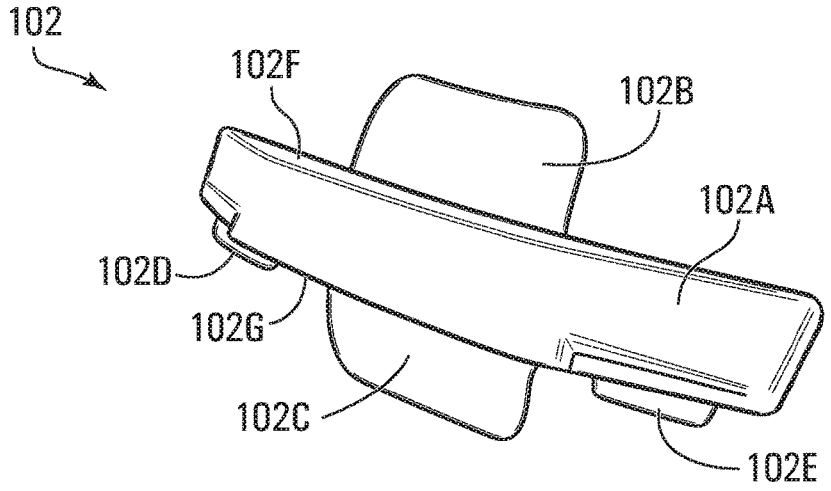
FIG. 14 is a perspective view of an insert in accordance with the present invention.
Figure 15:
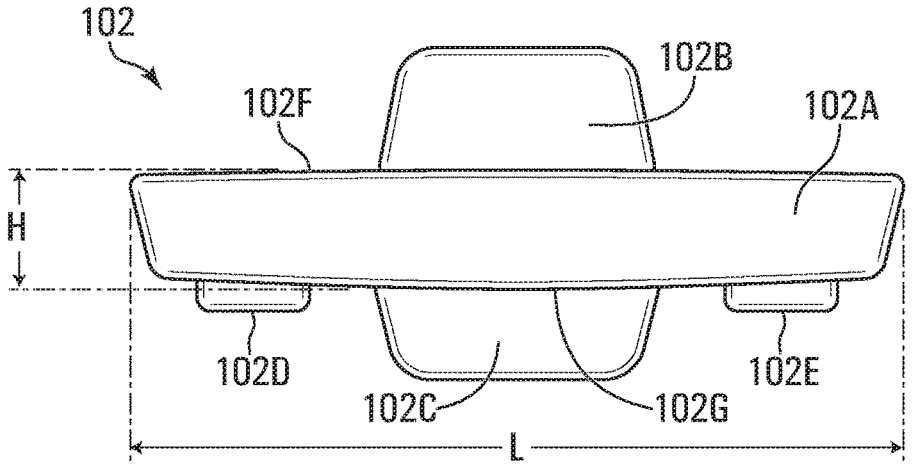
FIG. 15 is a front view of the insert of FIG. 14.
Figure 16:
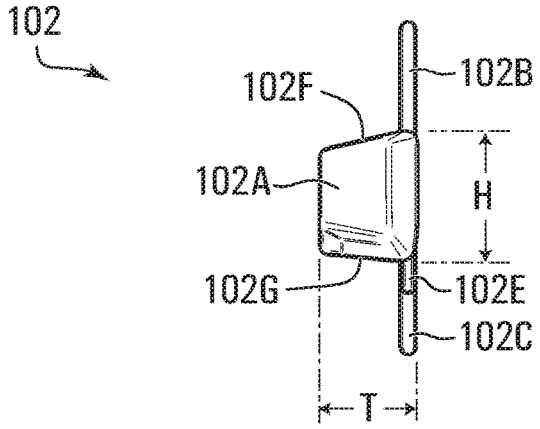
FIG. 16 is a side view of the insert of FIG. 14.

However, in order to allow the skater to adjust the flexibility of the tendon guard 43, the tendon guard 43 comprises a recess 100 for receiving an insert 102 (shown in FIGS. 14 to 16). As shown in FIGS. 14 to 18B, the recess 100 and the insert 102 may be independent and spaced from a lace used to secure the skate boot 10 on the user's foot and may be disposed elsewhere than at an exterior of the heel portion 44, ankle portion 46, medial side and lateral side portions 48, 50.

The recess 100 may be a longitudinal recess that extends in a direction generally transverse to a longitudinal axis A-A of the tendon guard 43.

The inserts 102 have a core 102A and connection means permitting removable connection between a given insert 102 and the tendon guard 43. The insert 102 may have connection means including protrusions 102B, 102C, 102D and 102E.

The recess 100 of the tendon guard 43 may comprise a housing portion 100A with upper and lower walls 100F, 100G provided in the tendon guard 43 and the recess 100 may also comprise grooves extending upwardly and downwardly in the tendon guard 43 (only grooves 100B, 100C are shown in FIG. 17). The main housing portion 100A of the recess 100 receives the core 102A of the insert 102 while the grooves of the recess 100 cooperate with corresponding protrusions 102B, 102C, 102D, 102E of the insert 102. In an alternative embodiment, instead of grooves, the tendon guard may include protrusions while the inserts may include respective grooves. In other embodiments, the insert can be mounted to the tendon guard 43 by being press-fit or snap-fit into the recess.

While the recess 100 is shown as having a substantially rectangular shape, the recess can have any shape suitable to receive a correspondingly shaped insert.

Figure 18A:
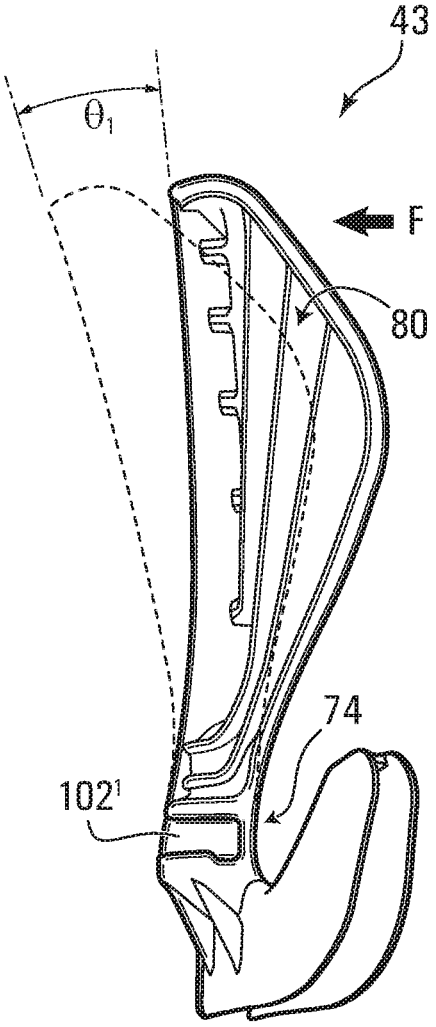
FIG. 18A is a side view of the tendon guard of FIG. 10 with a first insert positioned therein, showing the tendon guard in an initial position in solid lines and in a first bent position in dotted lines.
Figure 18B:
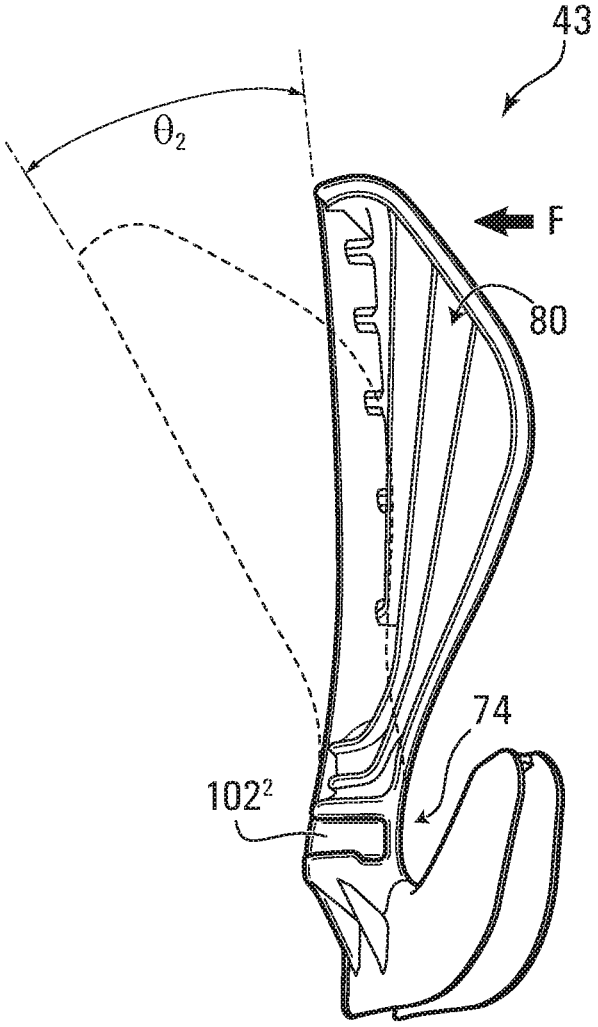
FIG. 18B is a side view of the tendon guard of FIG. 10 with a second insert positioned therein, showing the tendon guard in an initial position in solid lines and in a second bent position in dotted lines.

In order to facilitate placement and removal of the inserts into the recess, the flexing portion 80 of the tendon guard 43 can be bent in a forward direction (i.e.: opposite to the bending shown in FIGS. 18A and 18B). The recess of the tendon guard 43 will therefore open by a substantial amount, thereby permitting a skater to more easily place or remove a given insert into the recess. The natural resiliency of the tendon guard 43 will bias the flexing portion 80 of the tendon guard 43 to its initial position, thereby snugly holding the insert in place and avoiding that the insert become undesirably dislodged from the recess during use of the tendon guard 43.

The core 102A of the insert 102 may be made of a resilient material to permit compression of the core 102A when the upper and lower walls 100F, 100G abut against respective upper and lower surfaces 102F, 102G of the insert 102. As such, when the tendon guard 43 bends, the upper and lower walls 100F, 100G will compress the core 102A of the insert 102 by pressing against the upper and lower surfaces 102F, 102G. The resilient material of the core 102A permits such a compression. For example, the core 102A can be made of rubber such as natural rubber, isoprene rubber, polychloroprene, styrene butadiene rubber, etc.

Depending on the material, the insert 102 and/or core 102A of the insert 102 may have hardness values between 20 Shore A and 70 Shore D. For example, a very hard insert may have a hardness value between 60 and 70 Shore D, a hard insert may have a hardness value between 40 and 50 Shore D, a medium insert may have a hardness value between 20 and 30 Shore D, a soft insert may have a hardness value between 5 and 15 Shore D, and a very soft insert may have a hardness value between 15 and 25 Shore A. It is also understood that the insert may comprise a frame, skeleton or armature made of a relatively rigid material being covered or overmolded by a material having a hardness value lower from the one of the rigid material.

The protrusions 1028, 102C, 102D, 102E of the inserts 102 can be made of a more rigid material in order to be fixedly secured into their corresponding grooves. For example, the protrusions can be made of plastic such as polyvinyl chloride, polytetrafluoroethylene, polyethylene (low density or high density), polypropylene, etc.

With continued reference to FIGS. 14 to 16, it can be seen that the core 102A of the insert 102 has a length L, a height H and a thickness T. While the core 102A of the insert 102 is not of exact rectangular geometry, dimensions of length L, height H, and thickness T are used for simplicity. It is nevertheless understood that the core 102A of the insert 102 can have a variety of shapes while remaining within the scope of the present invention. For example, the core 102A of the insert 102 can be generally triangular or can have a curved periphery.

Different inserts can therefore be manufactured with different dimensions and different material in order to provide different levels of flexibility to the tendon guard 43 when inserted in the recess 100. For example, for a plurality of inserts with cores made of the same material, the height H and thickness T of the core may largely determine the amount of flexibility permitted by the tendon guard 43. Alternatively, the cores of the inserts can be made of different material but may have the same dimensions of length L, height H and thickness T. In yet other embodiments, the dimensions and the material can be changed from one insert to another. It can therefore be understood that a variety of different inserts can be manufactured to provide different levels of flexibility for the tendon guard 43.

Accordingly, a skater is able to adjust the flexibility of the tendon guard 43 as desired. This allows the skater to experiment with several different types of inserts in order to achieve a desired level of flexibility. On the other hand, if the skater determines that the natural resiliency of the tendon guard 43 without an insert is adequate, the tendon guard 43 can simply be used with the recess 100 being free of any inserts.

FIGS. 18A and 18B illustrate a tendon guard 43 having two different flexion modes. While it is understood that, during use, the tendon guard 43 is likely to experience bending under a pressure exerted on its inner surface, an equivalent force vector F is depicted in the figures for simplicity of illustration. In addition, the terms "flexion force" or "pressure" can be understood to represent any type of physical force or pressure capable of bending the tendon guard 43.

In each of FIGS. 18A and 18B, the tendon guard 43 is shown in an initial position in solid lines and in a bent position in dotted lines.

In FIG. 18A, a first insert $\mathbf{102}^1$ is positioned in the recess 100 of the tendon guard 43 while in FIG. 18B, a second insert $\mathbf{102}^2$ different from the first insert $\mathbf{102}^1$ is positioned in the recess 100 of the tendon guard 43.

Force vector F, which schematically depicts a flexion force which would be exhibited by the skater's leg, is the same in both cases and is applied at the same point on the tendon guard 43 in order to represent equivalent pressures in each of FIGS. 18A and 18B. While force vector F is shown as being applied along a particular line of action, it can be understood that other forces can be applied to the tendon guard 43 along any line of action to cause the tendon guard 43 to experience a backwards bending motion (flexing motion).

In experiencing the same flexion force (or pressure), the tendon guard 43 with the first insert $\mathbf{102}^1$ (FIG. 18A) defines a first flexing angle $\theta_1$ (a first bent position of the tendon guard 43 shown in dotted lines), while the tendon guard 43 with the second insert $\mathbf{102}^2$ (FIG. 18B) defines a second flexing angle $\theta_2$ (a second bent position of the tendon guard 43 shown in dotted lines), the second flexion mode being different from the first flexion mode because each of the inserts $\mathbf{100}^1$, $\mathbf{100}^2$ has different specifications.

As indicated previously, the tendon guard 43 has the flexing portion 80. When the first insert $\mathbf{102}^1$ is received in the recess 100, the flexing portion 80 flexes from its initial position to a first bent position being at a first angle $\theta_1$ from its initial position (FIG. 18A), and when the second insert $102^2$ is received in the recess 100, the flexing portion 80 flexes from its initial position to a second bent position being at a second flexing angle $\theta_2$ from its initial position (FIG. 18B), the first angle $\theta_1$ being different from the second flexing angle $\theta_2$ because each of the inserts $100^1$, $100^2$ has different specifications.

Hence, for a given force or pressure exerted on the tendon guard 43, a first backwards flexion of the skater's ankle A is permitted when the first insert $102^1$ is received in the recess 100 of the tendon guard 43, which then has a first flexing mode, while a second backwards flexion of the skater's ankle A is permitted when the second insert $102^2$ is received in the recess 100 of the tendon guard 43, which then has a second flexing mode, the second flexing mode being different from the first flexing mode.

Moreover, because of the different specifications of the inserts $100^1$, $100^2$, when the flexion force is no longer applied to the tendon guard 43, this tendon guard 43 may return to its initial position shown in solid lines according to different counter-forces because each of the inserts $102^1$, $102^2$ produces a determined force which counters the backwards bending of the tendon guard 43. More specifically, the upper and lower walls 100F, 100G will compress the inserts $102^1$, $102^2$ when the flexing portion 80 is bent. As such, the different inserts $102^1$, $102^2$ (which have different specifications) will exert different amounts of counter-force on the upper and lower walls 100F, 100G.

The term "specifications" may refer to any mechanical property or dimension of a given insert (such as hardness, density, shape, thickness, etc.).

In this example, at least one specification of the first insert $102^1$ is different from the corresponding specification of the second insert $102^2$. For example, it is possible that the first insert $102^1$ is made of a material which has a greater hardness value than the material of the second insert $102^2$. For instance, the first insert $102^1$ may have a hardness value higher than 30 Shore A while the second insert $102^2$ may have a hardness value lower than 30 Shore A, or the first insert $102^1$ may have a hardness value higher than 40 Shore A while the second insert $102^2$ may have a hardness value lower than 40 Shore A, or the first insert $102^1$ may have a hardness value higher than 50 Shore A while the second insert $102^2$ may have a hardness value lower than 50 Shore A, etc.

In other embodiments, it is possible that the first insert $102^1$ has a different physical dimension (such as a greater height H) than the second insert $102^2$. In a further embodiment, the first insert $102^1$ may have a full body while the second insert $102^2$ may have a slit, groove or opening provided therein. In another embodiment, the shape and/or dimension of the first insert $102^1$ is designed such that the first insert $102^1$ is substantially confined in the recess when received therein while the shape and/or dimension of the first insert $102^2$ is designed such that the second insert $102^2$ is slightly smaller than the recess thereby creating a gap between the insert $102^2$ and the walls of recess when the second insert $102^2$ is received in the recess.

The presence of a given insert in the recess 100 of the tendon guard 43 thus modifies the overall resiliency of the tendon guard 43.

Figure 19:
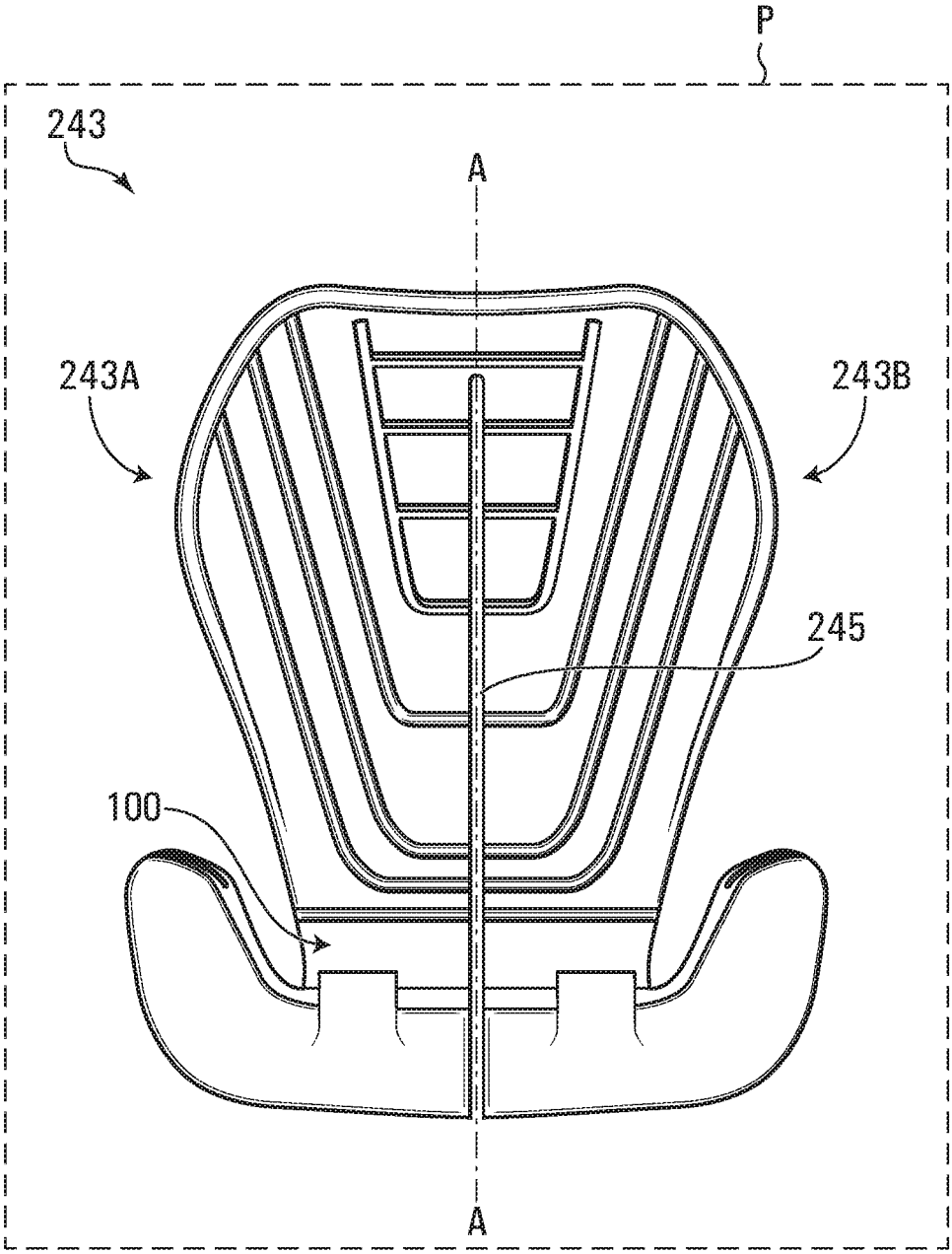
FIG. 19 is a rear view of a tendon guard in accordance with the present invention.
Figure 20:
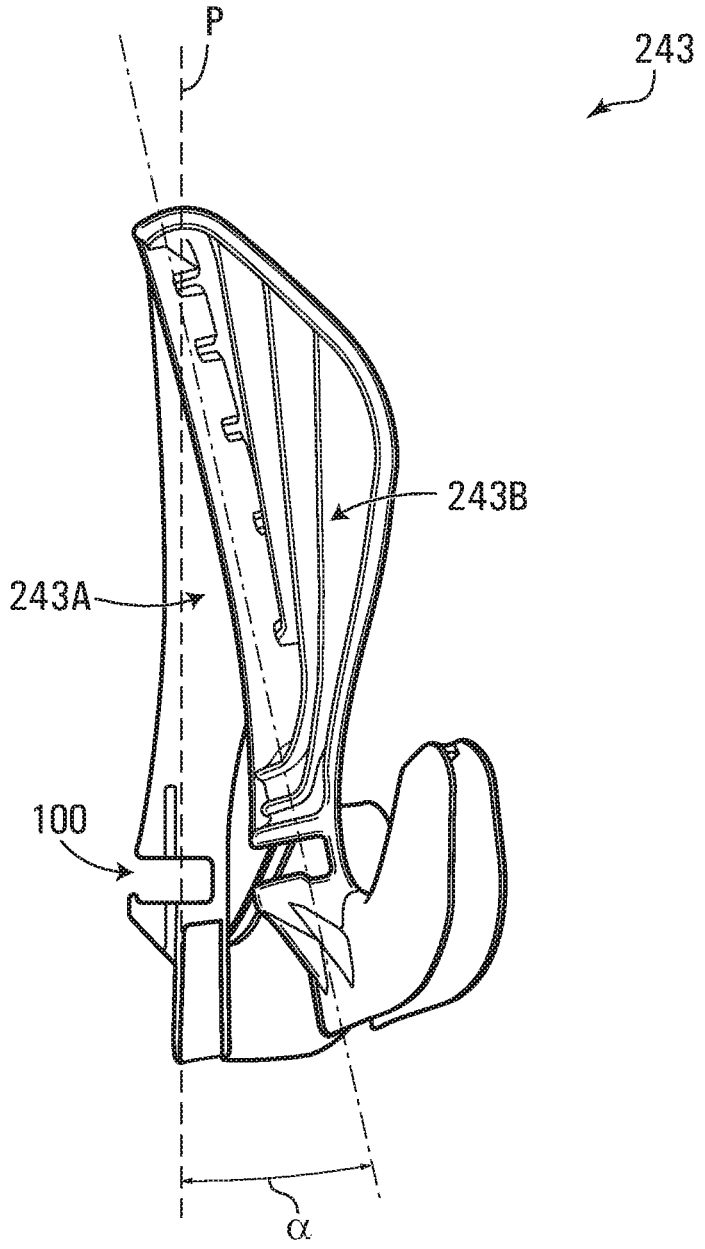
FIG. 20 is a side view of the tendon guard of FIG. 19, showing a portion of the tendon guard exhibiting out-of-plane bending.
Figure 21:
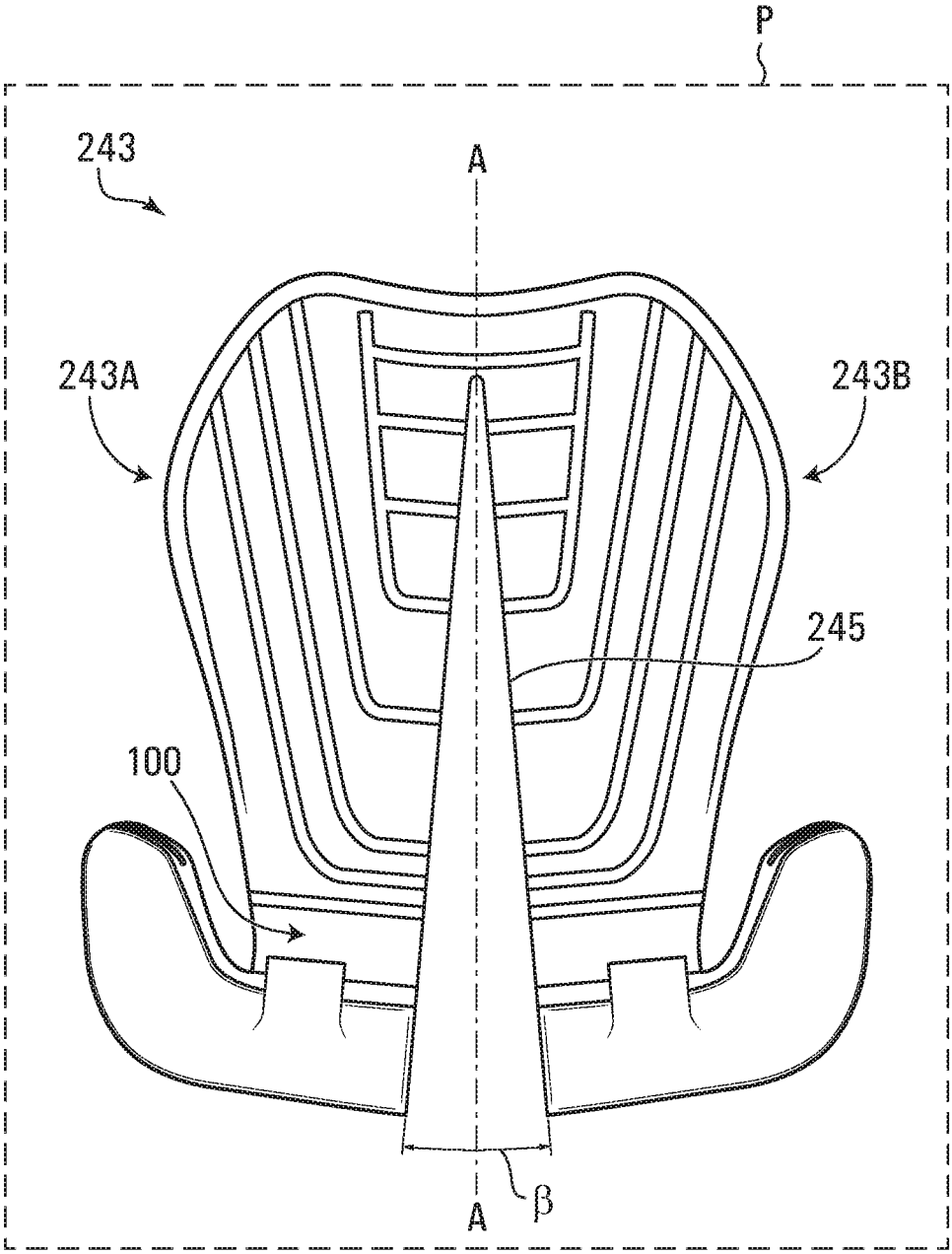
FIG. 21 is a rear view of the tendon guard of FIG. 19, showing the tendon guard exhibiting in-plane bending.

FIG. 19 to 21 show a tendon guard 243 with a central slit 245 in order to facilitate the placement and removal of the inserts $102^1$, $102^2$ in the recess 100. The slit 245 extends from the bottom portion of the tendon guard 243 in a direction towards the flexing portion of the tendon guard 243 and is generally parallel to the longitudinal axis A-A of the tendon guard 243. As shown, the slit 245 crosses the recess 100, and generally splits the tendon guard 243 into two portions (namely, a left portion 243A and a right portion 243B) thereby allowing a skater to bend the tendon guard 243. While the two portions 243A, 243B are shown to be of substantially similar size, it can be understood that the slit 245 can be cut onto the tendon guard such as to create left and right portions of different sizes and dimensions.

The tendon guard 243 may be seen as being within a plane P. The tendon guard 243 is capable of experiencing out-of-plane bending (as shown in FIG. 20) as well as in-plane bending (as shown in FIG. 21). More specifically, the out-of-plane bending allows one portion (243B) to move relative to the other portion (243A) such that they define an angle $\alpha$ between one another (FIG. 20). In addition, the in-plane bending allows the portions 243A, 243B to define an angle $\beta$ (FIG. 21). Depending on the dimensions of the slit 245 and the material properties of the tendon guard 243, angle $\alpha$ can have a value between 0° and 45° and angle $\beta$ can have a value between 0° and 30°. In addition, the dimensions of the slit 245 can also determine the possible ranges of angles $\alpha$ and $\beta$. It is understood that the slit 245 may be replaced by a recess or groove generally extending along the longitudinal axis A-A for allowing the in-plane bending only.

The ability of the portions 243A, 243B to exhibit in-plane and out-of-plane bending facilitates the placement and removal of the inserts into the recess 100. For allowing the out-of-plane and in-plane bending, it is also understood that the tendon guard would be removably attached to the outer shell 12 such that the skater is able to remove the tendon guard 243 from the outer shell 12 if he or she desires changing the insert.

Any feature of any embodiment discussed herein may be combined with any feature of any other embodiment discussed herein in some examples of implementation.

Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A skate, comprising:

a skate boot for receiving a foot of a user to skate, the skate boot being securable on the user's foot using a lace, the skate boot comprising an interior that defines a cavity to receive and engulf the entire user's foot and an ankle of the user and that is configured to contact a medial side of the user's foot, a lateral side of the user's foot, the user's ankle, and a heel of the user's foot, the skate boot comprising an exterior that is opposite to the interior of the skate boot and faces outwardly away from the user's foot and ankle; and a blade holder located underneath the skate boot;

wherein: a given part of the skate boot has a flexibility while the user skates; the skate boot comprises a flexibility-adjusting element that is configured to adjust the flexibility of the given part of the skate boot; and the flexibility-adjusting element is independent from the lace and is spaced from the interior of the skate boot and the exterior of the skate boot.

2. The skate defined in claim 1, wherein the flexibility-adjusting element comprises an insert for insertion into the given part of the skate boot.

3. The skate defined in claim 2, wherein the flexibility-adjusting element has a hardness value between 20 Shore A and 70 Shore D.

4. The skate defined in claim 1, wherein the given part of the skate boot comprises a body and wherein the flexibility-adjusting element is removable from and mountable to the body of the given part of the skate boot to adjust the flexibility of the given part of the skate boot.

5. The skate defined in claim 1, wherein the given part of the skate boot comprises a body including a recess and wherein the flexibility-adjusting element comprises an insert received in and removable from the recess.

6. The skate defined in claim 5, wherein the insert includes a protrusion or groove shaped to cooperate with a corresponding groove or protrusion on the body of the given part of the skate boot.

7. The skate defined in claim 1, further comprising a blade attached to the blade holder.

8. The skate defined in claim 1, wherein the given part of the skate boot is a tendon guard connected to a rear ankle portion of the skate boot and configured to face an upper part of the user's Achilles tendon.

9. The skate defined in claim 8, wherein the flexibility-adjusting element comprises an insert for insertion into the tendon guard.

10. The skate defined in claim 1, wherein the flexibility of the given part of the skate boot is dependent on at least one dimension, shape, density, thickness or hardness value of the flexibility-adjusting element.

11. A skate, comprising:

a skate boot for receiving a foot of a user to skate, the skate boot being securable on the user's foot using a lace, the skate boot comprising an interior that defines a cavity to receive and engulf the entire user's foot and an ankle of the user and that is configured to contact a medial side of the user's foot, a lateral side of the user's foot, the user's ankle a heel of the user's foot, the skate boot comprising an exterior that is opposite to the interior of the skate boot and faces outwardly away from the user's foot and ankle; and a blade holder located underneath the skate boot;

wherein: a given part of the skate boot has a flexibility while the user skates; the skate boot comprises a flexibility-adjusting element that is manipulable by a user to adjust the flexibility of the given part of the skate boot; and the flexibility-adjusting element is spaced from the lace, the interior of the skate boot and the exterior of the skate boot.

12. The skate defined in claim 11, wherein the given part of the skate boot is a tendon guard connected to a rear ankle portion of the skate boot and configured to face an upper part of the user's Achilles tendon.

13. The skate defined in claim 12, wherein the flexibility-adjusting element comprises an insert for insertion into the tendon guard.

14. The skate defined in claim 11, wherein the flexibility-adjusting element comprises an insert for insertion into the given part of the skate boot.

15. The skate defined in claim 14, wherein the flexibility-adjusting element has a hardness value between 20 Shore A and 70 Shore D.

16. The skate defined in claim 11, wherein the given part of the skate boot comprises a body and wherein the flexibility-adjusting element is removable from and mountable to the body of the given part of the skate boot to adjust the flexibility of the given part of the skate boot.

17. The skate defined in claim 11, wherein the given part of the skate boot comprises a body including a recess and wherein the flexibility-adjusting element comprises an insert receivable in and removable from the recess.

18. The skate defined in claim 17, wherein the insert includes at least one protrusion or groove shaped to cooperate with a corresponding groove or protrusion on the body of the given part of the skate boot.

19. The skate defined in claim 11, wherein the flexibility of the given part of the skate boot is dependent on at least one dimension, shape, density, thickness or hardness value of the flexibility-adjusting element.

20. The skate defined in claim 11, further comprising a blade attached to the blade holder.

21. A skate, comprising:

a skate boot for receiving a foot of a user to skate, the skate boot being securable on the user's foot using a lace, the skate boot comprising an interior that defines a cavity to receive and engulf the entire user's foot and an ankle of the user and that is configured to contact a medial side of the user's foot, a lateral side of the user's foot, the user's ankle, and a heel of the user's foot, the skate boot comprising an exterior that is opposite to the interior of the skate boot and faces outwardly away from the user's foot and ankle; and a blade holder located underneath the skate boot;

wherein: a given part of the skate boot has a flexibility while the user skates; the skate boot comprises a flexibility-adjusting element spaced from the lace; and the flexibility-adjusting element is configured to adjust the flexibility of the given part of the skate boot and is spaced from the interior of the skate boot and the exterior of the skate boot.

22. The skate defined in claim 21, wherein: the given part of the skate boot comprises a tendon guard connected to a rear ankle portion of the skate boot and configured to face an upper part of the user's Achilles tendon.

23. The skate defined in claim 1, wherein: the given part of the skate boot comprises molded material forming a molded void; the molded void is configured to receive the flexibility-adjusting element; and at least part of the molded material is configured to be disposed between the molded void and the user.

* * * * *